US005653679A

United States Patent [19]

Belanchi

[11] Patent Number: 5,653,679

[45] Date of Patent: Aug. 5, 1997

[54] MASSAGING MACHINE

[76] Inventor: Robert Belanchi, 3234 N. Burbank Blvd., Burbank, Calif. 91504

[21] Appl. No.: 382,844

[22] Filed: Jan. 30, 1995

[51] Int. Cl.[6] ..... A61H 7/00

[52] U.S. Cl. ..... 601/98; 601/103; 601/134; 601/136

[58] Field of Search ..... 601/84, 93, 97–99, 601/101, 103, 104, 92, 95, 115–117, 134, 136, 138

[56] References Cited

U.S. PATENT DOCUMENTS

| | | | |
|---|---|---|---|
| 663,969 | 12/1900 | Johnston et al. | 601/136 |
| 849,844 | 4/1907 | Laurence | 601/136 |
| 3,039,458 | 6/1962 | Hill | 601/116 |
| 3,812,846 | 5/1974 | Trout | 601/116 |
| 4,192,296 | 3/1980 | St. Mary | 601/102 X |
| 4,662,363 | 5/1987 | Romano et al. | 601/134 |
| 5,018,511 | 5/1991 | Yokoi | 601/61 X |
| 5,107,822 | 4/1992 | Ohashi | 601/93 X |
| 5,172,692 | 12/1992 | Kulow et al. | 601/102 X |
| 5,348,529 | 9/1994 | Veltri | 601/99 |

FOREIGN PATENT DOCUMENTS

| | | | |
|---|---|---|---|
| 44107 | 1/1982 | European Pat. Off. | 601/136 |
| 403251246 | 11/1991 | Japan | 601/92 |
| 1623651 | 1/1991 | U.S.S.R. | 601/104 |
| 1692578 | 11/1991 | U.S.S.R. | 601/98 |

*Primary Examiner*—Danton D. DeMille
*Attorney, Agent, or Firm*—Gilbert Kivenson

[57] ABSTRACT

A massaging machine which uses a plurality of spring-loaded metal fingers which move vertically up and down the back of an individual sitting in a chair. A relatively large portion of the back is involved and the action simulates that of a skilled masseur thus providing relief from stress and pain.

3 Claims, 3 Drawing Sheets

MASSAGING MACHINE

BACKGROUND OF THE INVENTION

The present invention relates to a motor driven massager which can be built into the back of a chair. The use of sliding finger pressure has been shown to be beneficial in the treatment of many ailments pertaining to bones and muscle structures. This type of therapy is expensive because of the skill and time required for each treatment. As a result many devices for applying a massaging action to the human back by a motor driven mechanism have been developed. These devices employ drums, spheres or disks which roll up and down a person's back while he lies face down on a bed, stands against a vertically moving roller set or sits in a reclining chair in the back of which are contained moving massage elements.

DESCRIPTION OF THE PRIOR ART

The massaging machines of Fujimoto (U.S. Pat. No. 4,079,732), Tanaka et al (U.S. Pat. No. 4,149,531) and Yamasaki (U.S. Pat. No. 5,352,186) are typical of electric massaging machines which are in the literature. These all employ twin disks or spheres which press on and roll along the spine while the person being massaged reclines in a chair. Fujimoto employs a threaded drive rod for vertically moving a carriage containing massaging spheres and a limit switch at each end of the carriage to reverse the motor. A second motor in the carriage imparts independent massaging motion to the spheres. The machine is relatively complex and expensive but does impart a finger-like pressure which simulates the hands of a masseur. Tanaka et al employ a similar drive mechanism with limit switches but uses elastomer covered disks to press on and roll along the sides of the spine. There is no simulation of finger pressure and movement. Yamasaki employs an elaborate spring system to force two disks into the back and to roll alongside the spine. This apparatus employs two motors, is complex and doesn't provide "finger" pressure.

SUMMARY OF THE INVENTION

It is a first objective of the present invention to provide a finger-like pressure on the entire back as the massage fingers move up and down.

It is a second objective to employ a sufficient number of fingers to massage a larger area of the back than the relatively small area alongside the spine.

It is a third objective of the invention to spring load each finger so that a "drag wave" is formed behind each finger as it moves, simulating the effect obtained by a skilled masseur. This type of massage has been found to be deep penetrating. It cannot be brought about by rolling disks, spheres or drums.

It is a fourth objective of the present invention to achieve oscillation by the use of a simple mechanical crank between a slow speed motor and finger-carrying plate thus eliminating the need for limit switches and special circuitry.

The present invention contains:

(i) a stationary frame which is firmly attached to a chair;

(ii) a vertically slidable plate which can move in the stationary frame;

(iii) a horizontal slot in the vertical plate holding a horizontally-moveable segment;

(iv) a crank arm between the horizontally moveable segment and the shaft of a slow speed motor;

(v) a plurality of spring-loaded, massage fingers which are moveable and bend against the back of a person seated in the chair;

(vi) a second stationary frame provided with slots through which the fingers can project and serving to hold most of the weight of the user.

As the slow speed motor turns, it drives the horizontally moveable segment and moves the slidable plate vertically. The fingers contact the user's back and deflect against their springs in conformance to the contour of his back. This imparts the "finger massage" action.

DETAILED DESCRIPTION OF THE INVENTION

Figure 1:
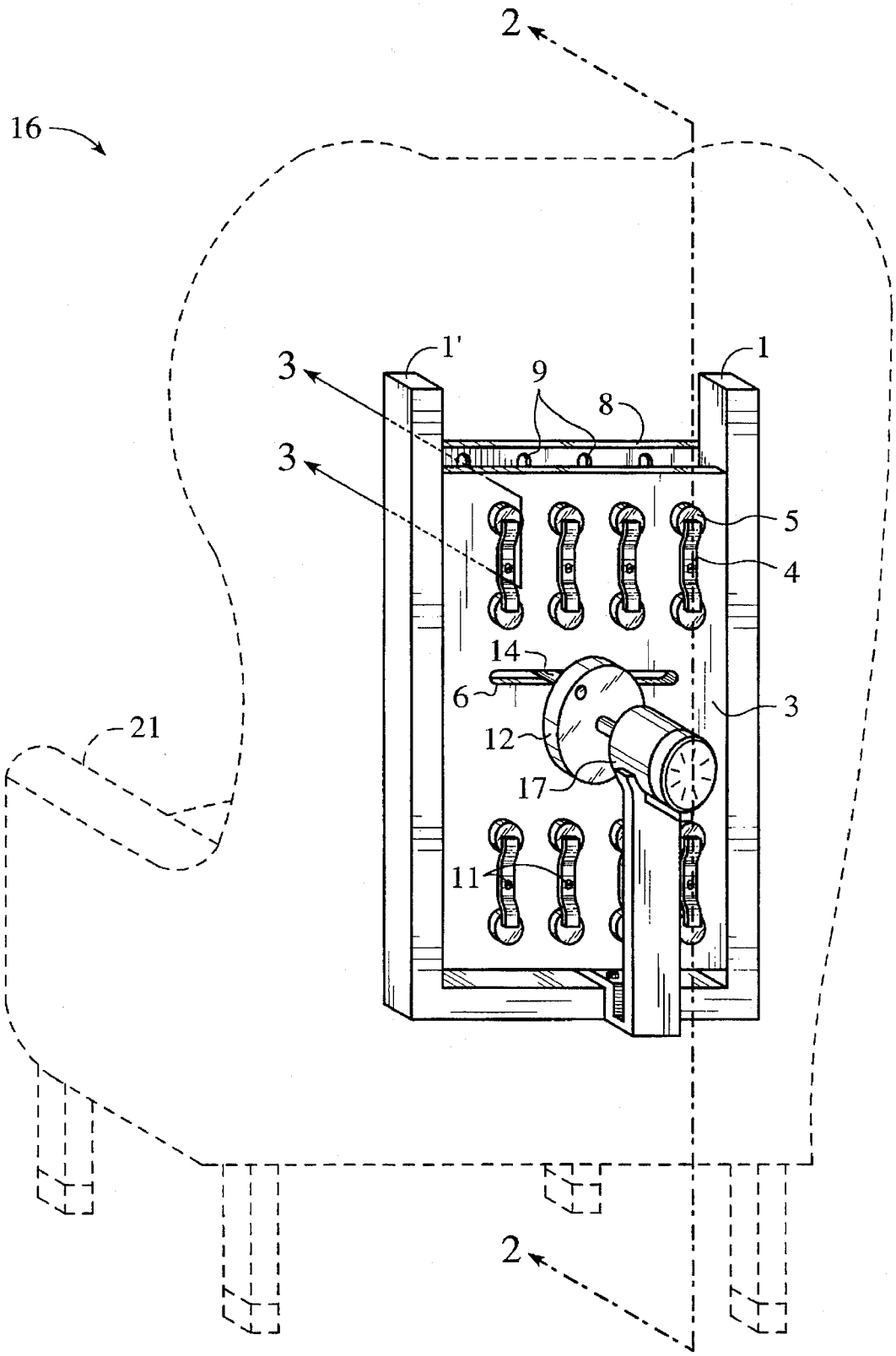
FIG. 1 is a rear perspective view of a chair equipped with a preferred embodiment of the present invention.
Figure 2:
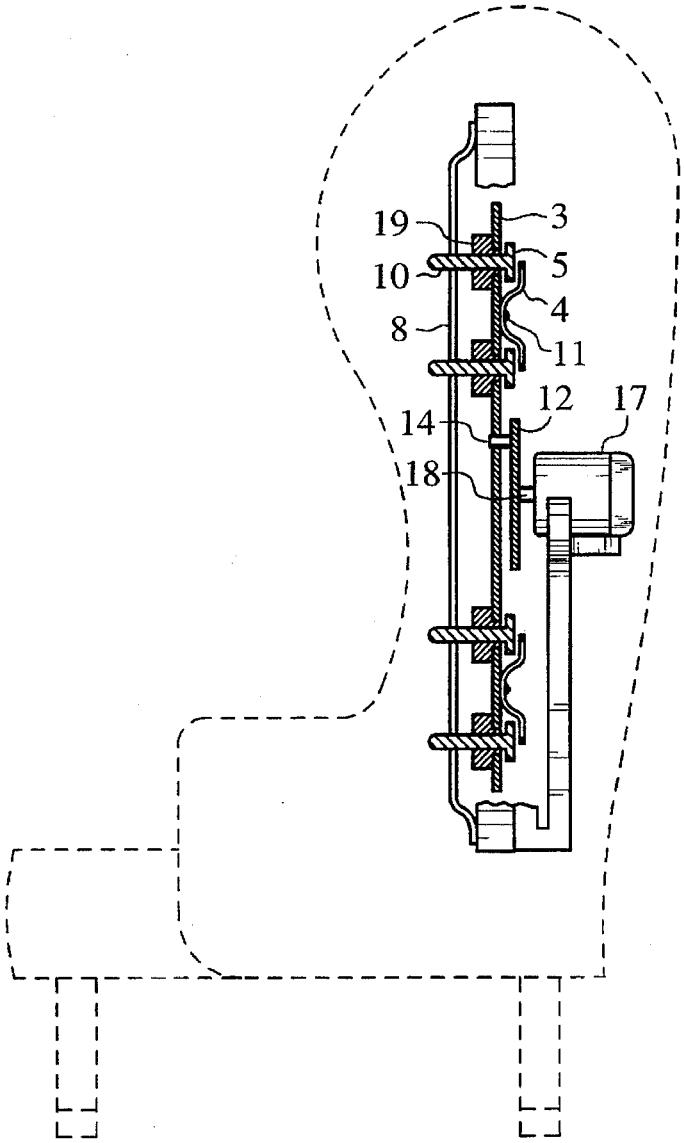
FIG. 2 is a cross section of the chair shown in FIG. 1 taken along the line 2—2'.

The operation of the massaging machine will now be described with references to FIGS. 1–4. In FIG. 1 the stationary frame made up of the rails 1 and 1' is rigidly attached to the back of a chair 16. A vertically-moveable plate 3 is mounted between the rails so that it is able to slide. A horizontal slot 6 is cut in plate 3 and accommodates the horizontally-moveable segment 14. A disk 12 is mounted between segment 14 and shaft 18 of the slow speed motor 17 (FIG. 2). The disk is mounted concentrically while the segment 14 is mounted off axis. As the motor turns, segment 14 moves horizontally while the vertical component of the motion is taken up by plate 3 sliding in rails 1 and 1' vertical, oscillating motion of plate 3 is thus obtained without the use of limit switches or reversible motors as is the case in some prior art. This type of cranking arrangement is a known machine element called a Scotch yoke. Its application to massaging mechanisms to achieve compactness and lower manufacturing costs is however unique to the present invention.

Figure 3:
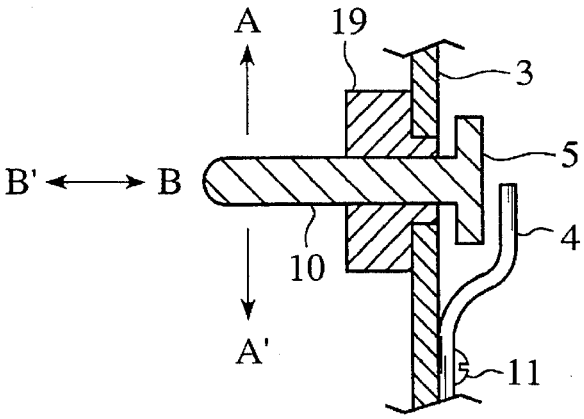
FIG. 3 is a cross section of the spring loaded fingers taken across 3—3' of FIG. 1.

Mounted in plate 3 are a plurality of flanged massaging fingers 10 having rounded ends (FIGS. 2 and 3). The fingers pass through and are free to slide in collars 19 which have been fixed into plate 3. The flanges 5 of each finger are held in contact with the back of plate 3 by flat leaf springs 4 which are mounted to the plate by the bolts 11. The vertical motion of plate 3 produces simultaneous movement in direction A—A' of all the fingers. The varied horizontal resistance corresponding to the curvature of the user's back causes movement in direction B-B' (FIG. 3) against the force of the springs. The overall effect is the creation of moving force in the skin and the creation of a deep massage effect.

Figure 4:
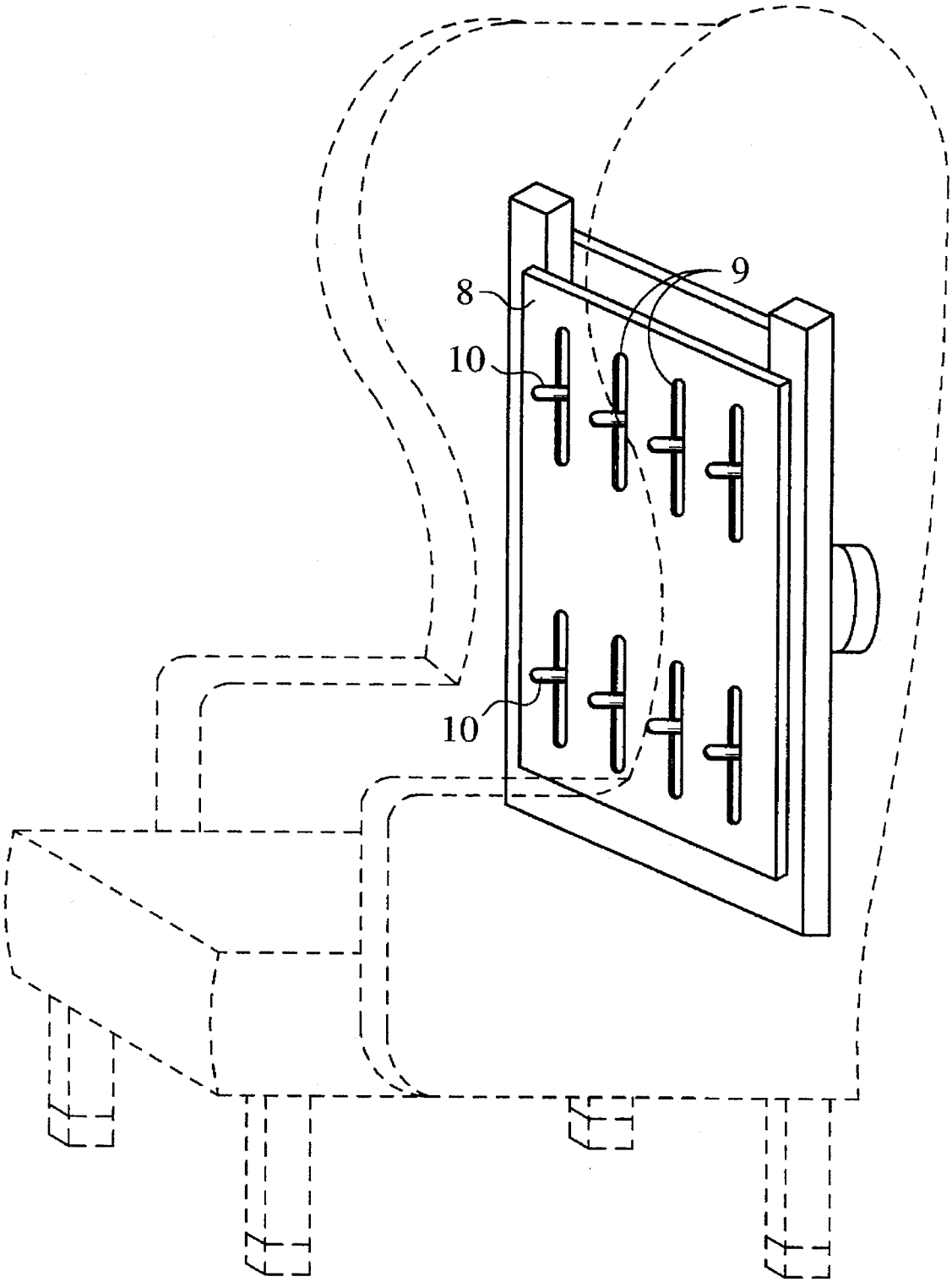
FIG. 4 is a front perspective view of the chair of FIG. 1.

Body support plate 8 is fixed at top and bottom to rails 1 and 1' as shown in FIGS. 1, 2 and 4. It contains the vertical slots 9 to accommodate the passage of the massage fingers 10. The weight of the user rests against support plate 8 and doesn't affect the pressure exerted by the fingers.

Other embodiments of the invention would include the use of compression springs for the fingers, a variable speed motor and other cranking means for producing oscillating motion.

What is claimed is the following:

1. A motor driven massage machine configured in the form of a chair and comprised of (a) a substantially horizontally seating surface provided with a generally vertical rear structure;

(b) stationary vertical rails built into said rear structure;

(c) a slider plate containing multiple perforations which is mounted between said rails so as to be vertically moveable;

(d) oscillating means coupled to said slider plate to produce continuous up and down motion over a preset amplitude;

(e) metal fingers with rounded ends slidably mounted in said slider plate so as to pass through said perforations and be forwardly biased by flat leaf springs mounted on the rear of the slider plate;

(f) a chair back surface slotted vertically to allow horizontal and vertical movement of the fingers, the chair back surface on said rear structure supporting the weight of a user:

whereby, when an individual sits on the horizontal seating surface and leans back against the rear structure with the oscillating means turned on, all the the fingers move horizontally, some make contact with his back and move horizontally in and out because of their spring bias and the horizontal resistance they encounter, this horizontal and vertical motion simulating that of the massage produced by the fingers of a skilled masseur.

2. A motor driven massage machine as described in claim 1 in which the slotted chair back serves to hold most of the weight of the user while allowing the said fingers to pass through and contact the user's back to maximize massaging action and minimize lifting force.

3. A motor driven massage machine as described in claim 1 in which said oscillating means is a meter driven disk coupled to a moveable segment mounted in a horizontal slot cut into said slider plate, the combination of said disk segment and slot constituting a simple cranking mechanism for changing rotary to linear motion.

* * * * *

UNITED STATES PATENT AND TRADEMARK OFFICE

CERTIFICATE OF CORRECTION

PATENT NO. : 5,653,679
DATED : August 5, 1997
INVENTOR(S) : Belanchi

It is certified that error appears in the above-identified patent and that said Letters Patent is hereby corrected as shown below:

On the title page, item [76]

Inventor's name and address are incorrectly printed as:

Robert Belanchi
3234 N. Burbank Blvd.
Burbank, Calif. 91504

The correct name and address are:

Robert Balanchi
3234 N. San Fernando Blvd.
Burbank, Calif. 91504

Signed and Sealed this

Sixteenth Day of December, 1997

Bruce Lehman

*Attest:*

BRUCE LEHMAN

*Attesting Officer*

*Commissioner of Patents and Trademarks*